US005727364A

United States Patent [19]

Artieda

[11] Patent Number: 5,727,364

[45] Date of Patent: Mar. 17, 1998

[54] PERFECTED PACKAGING FOR THE WRAPPING OF MAINLY CYLINDRICAL AND LONG SHAPED BODIES, SUCH AS ARTIFICIAL TRIPE

[75] Inventor: Angel Iso Artieda, Pamplona, Spain

[73] Assignee: Viscofan, Industria Navarra de Envoltras Celulosicas S.A., Pamplona, Spain

[21] Appl. No.: 708,047

[22] Filed: Aug. 30, 1996

[30] Foreign Application Priority Data

Sep. 14, 1995 [ES] Spain ..... 9501791

[51] Int. Cl.[6] ..... B65B 61/00

[52] U.S. Cl. ..... 53/415; 53/444; 53/461

[58] Field of Search ..... 53/397, 399, 410, 53/413, 415, 416, 419, 441, 443, 444, 447, 449, 461; 206/442, 443, 497, 499, 802

[56] References Cited

U.S. PATENT DOCUMENTS

| | | | |
|---|---|---|---|
| 1,381,425 | 6/1921 | Oldham | 53/415 |
| 3,283,893 | 11/1966 | Durocher et al. | 53/444 |
| 4,785,609 | 11/1988 | Widmann | 53/461 |
| 4,874,256 | 10/1989 | Baines | 53/413 |
| 4,959,946 | 10/1990 | Doyle | 53/415 |
| 5,079,900 | 1/1992 | Pinckney et al. | 53/413 |
| 5,356,007 | 10/1994 | Feldt | 53/444 |
| 5,381,643 | 1/1995 | Kazaitis et al. | 53/444 |
| 5,382,190 | 1/1995 | Graves | 53/444 |
| 5,391,108 | 2/1995 | Feldt | 53/444 |
| 5,467,576 | 11/1995 | Hendriks | 53/444 |

*Primary Examiner*—Daniel Moon
*Assistant Examiner*—Ed Tolan
*Attorney, Agent, or Firm*—Notaro & Michalos P.C.

[57] ABSTRACT

A packaging for a grouping of casing sticks of artificial tripe or wrappers in an overlapping alignment having a quincuncial arrangement forming a parallelepiped block has a transparent cover which is adapted to surround the parallelepiped block. The packaging has a tubular configuration where two ends of the packaging overlap on the block. The overlapping two ends define a sealing line which is located upon the middle line of one of the larger surfaces of the block. The ends of the tubular element are folded so as to fit over the ends of the sheaths. Flaps at the open sides of the packaging are folded down onto the same surface of the block on which the sealing line is located, and specifically upon the end areas of the sealing line. The transparent packaging cover is stabilized by an adhesive tape strip which is placed covering the sealing line and the folded flaps. The adhesive tape may have an adhesive free section arranged to form a manual grab tab for allowing the package to be easily opened. The tape may extend at one end by a substantial length which reaches the opposite surface of the block upon which an intermediate length is defined which stands apart from the block and may be used as a manual block grip handle.

14 Claims, 2 Drawing Sheets

A-B

C-D

PERFECTED PACKAGING FOR THE WRAPPING OF MAINLY CYLINDRICAL AND LONG SHAPED BODIES, SUCH AS ARTIFICIAL TRIPE

OBJECT OF THE INVENTION

This invention refers to a new packaging, specially designed for the packaging and transportation of the sheath wraps that configure artificial tripes, packaging which is nevertheless equally applicable to any other practical case requiring a similar level of performance.

The packaging, achieving an optimum use of available space in order to minimize storage and freight costs, has been designed and structured so as to achieve, on the one hand, the maximum speed in the packaging process itself and, on the other hand, optimal sealing conditions guaranteeing the complete protection of its contents against the surrounding environment. This packaging does furthermore afford a considerable cost saving in respect to traditional packaging systems, similarly achieving a lesser recycling volume when used.

Regarding its use, this packaging improves the hygiene conditions of traditional packaging devices, allowing its use at Frankfurt style sausage filling rooms, where the hygiene standards that must be observed are very demanding.

Finally, this packaging device makes it possible to manage its product contents faster at sausage filling rooms, which translates into labour cost savings.

BACKGROUND OF THE INVENTION

As already known, artificial tripes, which may be of several different types: cellulosic, made using regenerated cellulose, reinforced or fibrous cellulosic, plastic or collagenous tripes, based on regenerated animal collagen, are marketed in the shape of sheath wraps where these wrappers appear considerably shrunken, so that a sheath wrap with a length of between 20 and 50 centimeters houses up to some 70 meters of actual cellulosic wrapping.

These sizes are determined by market requirements, it is also the market that determines that the previously mentioned cellulosic wrapping sheaths must be grouped or packaged forming blocks generally made up of 50 units, although the number of units may vary as per the specific needs of clients.

On the other hand, and as it will be obvious, the volume occupation of these units must be minimal, so that storage and freight costs may be similarly minimized.

In this regard it is already known, through U.S. Pat. Nos. 5,137,153 and 5,228,572, the formation of prismatic octagonal packages or bales, in which the cellulosic wrapping sheaths are quincuncialy arranged, that is to say, under conditions of maximum proximity, presenting said prismatic octagonal configuration a trend towards forming an irregular hexagonal section, but without quite managing it, being prevented by the previously mentioned number of units that must be included in the package.

This causes the latter coupling between packages, effected in order to form a larger freighting unit, and also seeking an optimal coupling through a quincuncial distribution, to leave empty or unused spaces between the various packages, which will feature a square rectangular section and a considerable volume, and which will have a negative influence upon their overall volume occupation and will consequently be the cause of additional storage and, more particularly, freight costs.

On the other hand, these patents focus their features exclusively upon the means used to group and fix the lengthened bodies, that is to say, the cellulosic wrapping sheaths, establishing that the attachment between them be effected using a paper or plastic side strip, which may even be split in a number of parts, using strips to effect this holding, but always for the purpose of holding the previously mentioned bodies.

These groupings do not have side or end covers, although they may be optionally included, which proves a certain lack of foresight and even the lack of a final suitability to effect a water proof seal, which may cause its contents to dry off and to age prematurely, as well as the ingress of undesirable materials or dust particles.

Another solution already known for this type of groupings is made up by simple cardboard boxes, on one of which sides are fitted deformable bodies, such as for instance polyurethane foam, which achieve a tight fit by applying pressure upon these bodies but in which the spaces left between these long shaped bodies causes the presence of a large quantity of idle space. Thus, in this case the already mentioned boxes make it possible not to leave any spaces between them, causing an optimal use of available space, but notwithstanding this, gaps are already left inside each one of the boxes due to the characteristics of the grouping of the elements to be housed therein, being the space actually wasted quite substantial. On the other hand, the materials used to manufacture the boxes are not acceptable from the hygienic-public health point of view, due to their representing a risk of development of cultures or growth of undesirable mildews or other contaminating elements, so that they must be kept out of foodstuff handling and processing rooms. The public health legislation of most countries tend to ban the previously mentioned presence.

It is also important to reduce the volume of waste generated by packing materials, with the resulting savings in respect of their handling, freighting, storage and recycling costs.

Trying to solve this problem, the applying company is the owner of a Spanish invention patent with application number 9400493, that describes a packaging for the wrapping of artificial tripes, based on the grouping of wrap sheaths made up of the above tripes, forming overlapping alignments, with a quincuncial distribution, resulting in the achievement of a basically prismatic-rectangular block, which is then stabilized through the addition of a see-through cover, made from a recyclable material apt to remain inside a foodstuff handling or processing room, from the hygienic-public health point of view such as, for instance, low density polyethylene, effecting the final stabilization with the help of two ringing bands laterally arranged and a further lengthwise ringing band, preferentially made of expanded polyethylene, which are then advantageously lock upon themselves using an appropriately arranged seam.

This solution to the previously examined problem does nevertheless hold ancillary problems, specifically the fact that, should any of the already mentioned ringing bands break, the whole package would then be unbalanced, and also that a possible excessive pressure of the ringing bands could cause the artificial tripe sheaths to deform. On the other hand, the wrapping plastic remains held just by pressure, so that it may be partially unwrapped without the packaging bands being fully withdrawn.

It would be similarly worthwhile to mention U.S. Pat. No. 5,381,643, which describes a pack of cellulosic wrappers prepared on site, upon the sheath bale itself. This wrapping is effected using heat retracting plastic and its fundamental problem is the fact that, during the warming up of the heat retracting film, there is a high risk that the plastic material will stick to the periphery of the sheath block, disabling some of those adopting a marginal position, or else they may adhere to the ends of the sticks, so that they become entangled when handled. The only advantage represented by this retracting method is that the size of the packs or caddies is made more uniform by being applied at the ends.

This same set of problems is also inherent to U.S. Pat. Nos. 5,382,190, 5,391,108 and 5,356,007.

An adhesive strip is specifically set out in the latter patent, but it is located within the flaps, so that this adhesive strip is valid only to enable the plastic film to adopt a tubular configuration, but notwithstanding this the sealing of its ends is also effected using heat welding process.

DESCRIPTION OF THE INVENTION

The packaging proposed by the invention, starting from an artificial tripe sheath arrangement similar to that already set out in Spanish Patent number 94000493, which is to say, forming a basically prismatic-rectangular block, and starting also from the use of a transparent, translucent or opaque cover, which may or may not be printed and which shall be made of material that is recyclable and acceptable at foodstuff handling or processing rooms, from the hygiene-public health point of view, focusing its characteristics in the fact that the previously mentioned transparent, translucent or opaque cover, which may or may not be printed and which shall be fittingly oversized in respect of the prismatic block, is then rolled upon such block defining an external sealing line, the ends of the previously mentioned rolling are then folded and brought down upon the external sealing line, and finally such ends are then simultaneously fixed using adhesive tape which, at the same time that it fixes the previously mentioned folds, determines a water proof seal upon the previously mentioned sealing line.

In accordance with a preferred example of practical execution of the invention, the previously mentioned adhesive tape extends considerably at one of its ends so that, after fixing the folds of the package and water proofing its sealing line, extends substantially at one of the ends of the package to affix itself upon the larger side of the package opposite that on which the sealing line is located, configuring a grip handle which, allowing the introduction of the fingers between the adhesive tape and the package itself, eases considerably the extraction of the package form within the container case.

In accordance with this execution and with other of the characteristics of the invention, and in order to prevent the adhesive tape from affixing itself upon the covering wrap around the area where the grip handle is to be configured, it has been further foreseen that around that area the adhesive tape shall be, either firmly stuck upon itself, thus loosing its adhesive properties in respect to the package, or alternatively covered with a strip of paper or similar material, so that the same effect may then be achieved.

Given that the structure of the sheaths configured by the artificial tripes demand their specific and determined positioning by the machine, in such a way that, in order to avoid handling problems, the tripe packages are conveniently located in the corresponding container boxes so that upon opening them the sheaths shall then be properly oriented, it would be enough for the previously mentioned grip handle to be set as an extension of one of the ends of the classic sealing adhesive tape but, notwithstanding this, and as will be obvious, there is also the possibility of setting a handling grip handle at each one of the two ends of the package.

An easily formed packaging is then achieved, using minimal quantities of material and achieving optimal sealing conditions, and which may furthermore be easily handled.

In accordance with another one of the characteristics of the invention, it has been further foreseen that the previously mentioned adhesive tape be either clean of adhesive material or else folded up at a short section at its terminal end, thus determining a grip tab easily capable of being manually grabbed, so that it may be removed and the packaged opened, when required.

DESCRIPTION OF THE DRAWINGS

In order to complement the description made herein, and so as to aid the better understanding of the features of the invention, this patent specification includes, as an integral part thereof, a set of drawings where the following has been duly represented with a merely illustrative but not limitative character.

PREFERRED EXECUTION OF THE INVENTION

Upon observing these figures it may be observed how the packaging herein advanced starts off the quincuncial arrangement of a plurality of artificial tripe sheaths (1), forming, for instance, five overlapping alignments, of ten units each, so that they do overall define a basically prismatic-rectangular block easily coupled with other similar blocks, for their storage.

The artificial tripe sheaths (1), thus arranged or interlocked, are then definitely stabilized through the cooperation of a covering film (2), preferably transparent and which may be made of any type of plastic, retracting or otherwise such as, for instance, low density polyethylene, slippery or non slippery, with a gauge of around 250±5%, although different gauges are similarly acceptable without this difference affecting the essentiality of the invention, a density of 0.9222±0.001 g/cm$^3$, and a fluidity index which may well be of 2.5±g/10 minutes, although different indexes are similarly acceptable.

Figure 1:
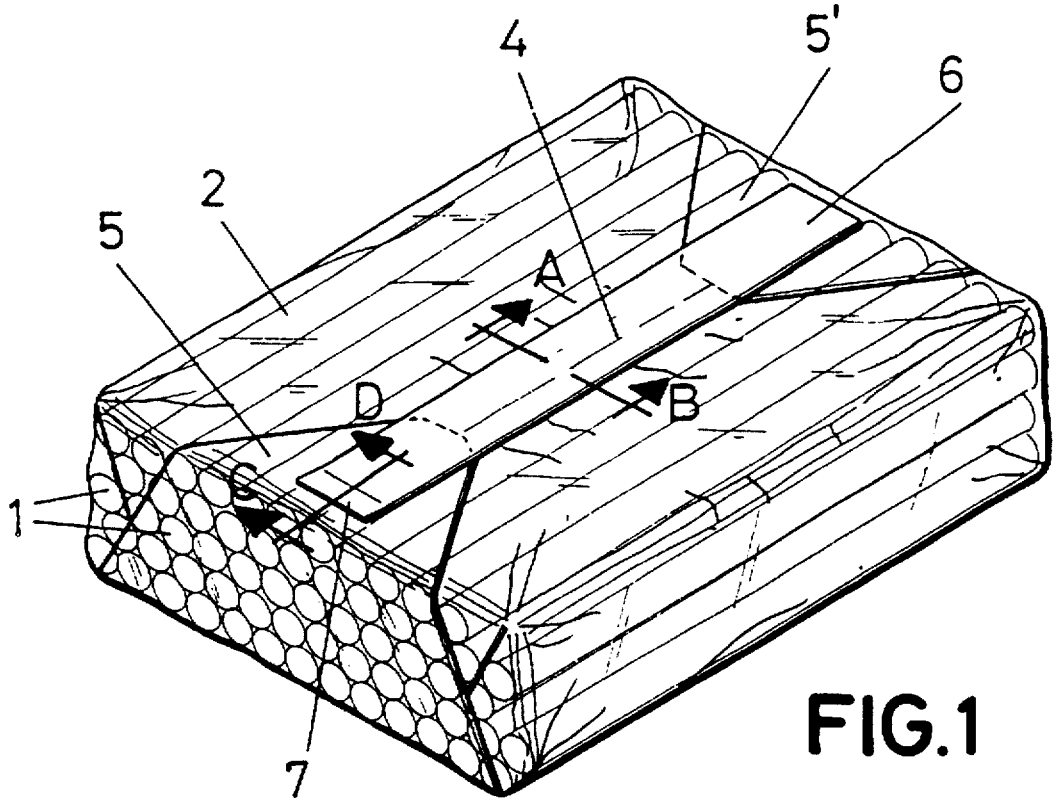
FIG. 1.—Represents a general perspective view of a packaging for the packing of substantially cylindrical and long shaped bodies, specifically artificial tripe sheaths, effected in accordance with the invention.
Figure 2:
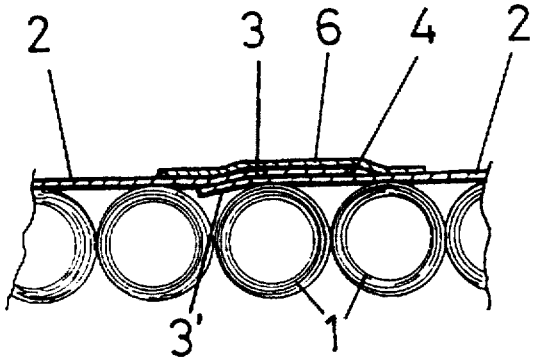
FIG. 2.—Represents a side section detail of the packing described above, in accordance with the A-B cutting line of FIG. 1.

In any case, and as may be particularly observed in FIG. 1, this transparent cover (2), is wrapped upon a block of sheaths (1), so that their marginal areas (3–3'), which may be observed in FIG. 2, overlap the intermediate line of one of the larger surfaces of the prismatic block, forming a sealing line (4), also clearly visible in FIG. 2 and which shall be the subject of additional comments further on.

This wrapping of the covering film (2), causes its tubular configuration, with end sectors that extend in respect of the block of sheaths (1), end sectors that are subjected to a classical folding designed to adapt the cover to the prismatic configuration of the block of sheaths, so that tapered end flaps (5) are obtained, which flaps fold down upon the previously mentioned sealing line (4) so that the attachment of these flaps (5–5') is then effected with the aid of a strip of adhesive tape (6) that simultaneously constitutes the covering element and final seal for the previously mentioned sealing line (4).

Figure 3:
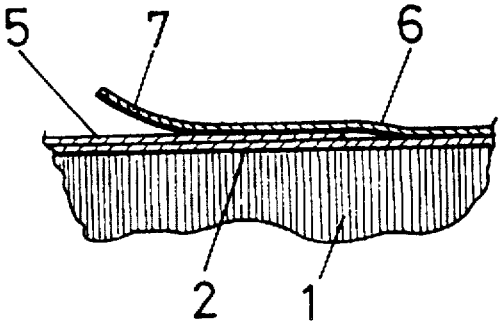
FIG. 3 is a sectional view taken along line C-D of FIG. 1.

This adhesive tape (6) is, as may be particularly observed in FIGS. 1 and 3, fitted at one of its ends with a short terminal sector (7) lacking adhesive, which determines a manual grab tab that enables a pulling action to be easily exerted upon the adhesive tape, whenever it is to be removed, during the performance of the packaging opening operation.

Figure 4:
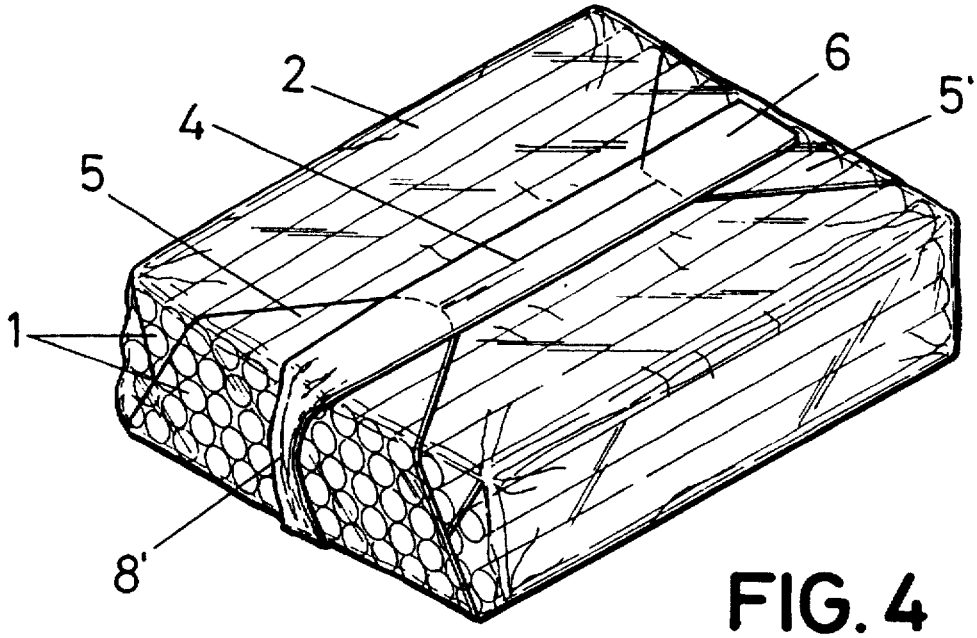
FIG. 4.—Represents a perspective view similar to that shown in FIG. 1, but corresponding to the execution variant in which the adhesive tape extends at one of its ends in order to configure a package holding grip handle.
Figure 5:
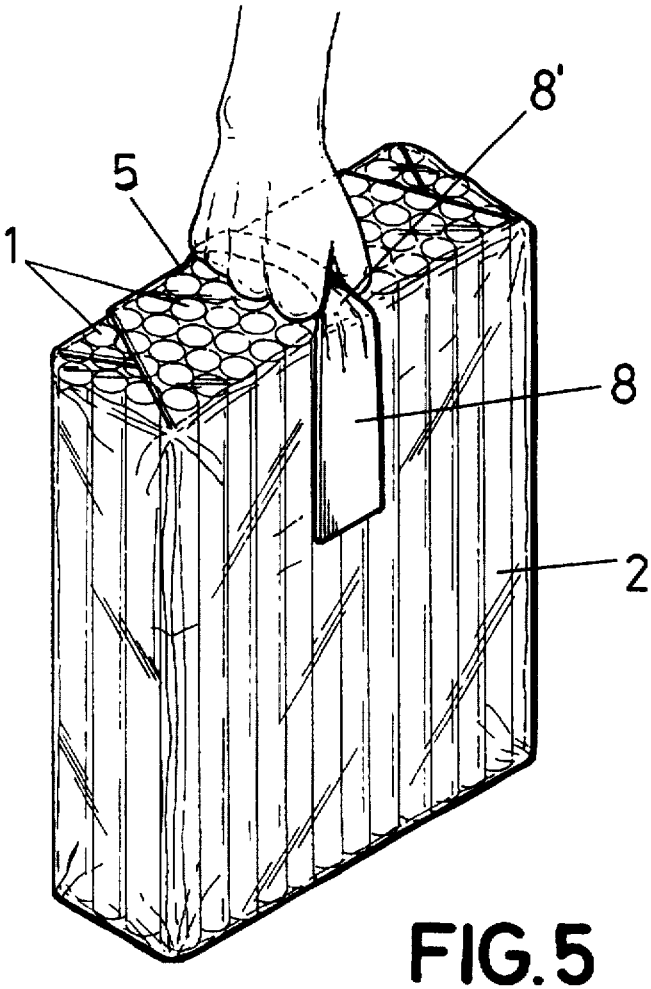
FIG. 5.—Represents, finally and also as per a perspective view, the same package of packaging already shown in the previous figure, here shown being handled between the container box and the sausage filling machine.

In accordance with a preferred example of practical execution of the invention, as previously mentioned and as may be observed in FIGS. 3 and 4, the adhesive tape (6) is extended at one of its ends by a sufficiently long sector (8) that, upon overlapping one of the ends of the package, reaches the larger and opposite surface of the package, which is to say that opposite the surface where the sealing line (4) has been set, defining in correspondence with the previously mentioned extension a grip handle (8') which purpose is to enable the set to be manually held, as may be particularly observed in FIG. 4.

In order to prevent the adhesive tape (6), at any part of the previously mentioned extension (8), and more specifically at the sector (8') that makes up the grip handle, from affixing itself to the covering film (2), so as to lose its effectiveness as a grip handle, it has been foreseen that the tape be folded upon itself, as shown in FIGS. 3 and 4, or else internally covered by a film made of paper or similar material, thus effectively inhibiting its adhesive properties in that area.

Although the practical execution example shown in the figures includes the provision of a single grip handle (8') located at one of the ends of the adhesive tape (6), that tape may well be fitted with another similar extension at its other end, so as to define a grip handle oppositely located in respect of the first one, thus allowing the package to be manually gripped from either end.

In any case it is achieved that, upon opening the case containing a number of packages of cellulosic tripe sheaths (1) packed as described above, each one of those packages would then offer the operator a grip handle (8') which would greatly ease its extraction without any risk of the package becoming undone.

It may thus be deduced, from the above comments, that the package herein advanced includes a plastic film (2) of the minimal possible size, strictly that demanded by the volume of the tripe sheath block (1), with the adhesive tape (6), also featuring the minimum possible length, acting as its sole sealing means, thus achieving that the sealing be effected through a fast and easy manoeuvrer, further being that seal fully efficient, both from the point of view of the retention of the film material and from the point of view of isolating the artificial tripe sheaths from their external environment, further configuring an easily handled package.

I claim:

1. A packaging for wrapping cylindrical, elongated bodies of artificial tripe, the bodies having overlapping alignments, in a quincuncial orientation forming a substantially parallelepiped block having two opposed surfaces each having a surface area greater than the surface areas of the remaining sides, the packaging comprising:

a cover which is one of transparent, translucent and opaque, and the cover being laminar or not laminar and elastic or not elastic, said cover being wrapped lengthwise upon the parallelepiped block defining a sealing line which is parallel to the lengthwise axis of the bodies, the cover having end areas which are folded such that the folded end areas adapt themselves to the ends of the parallelepiped block and define a pair of end flaps, one flap at each end of the block which pair of flaps are folded down over the sealing line on the parallelepiped block; and an adhesive tape strip, having one adhesive surface, for stabilizing the cover on the parallelepiped block placed over the sealing line and the adhesive tape strip having ends overlapping the end flaps of the cover.

2. A packaging according to claim 1, wherein at one end of the adhesive tape, a tape extension extends beyond the corresponding end of the parallelepiped block and the tape extension is attached to a side of the block opposite the side of the block on which the sealing line is formed such that the tape extension forms a grip handle spaced apart from the end of the parallelepiped block and having means for preventing the tape extension from adhering to the end of the parallelepiped block.

3. A packaging according to claim 2, wherein the means for preventing the tape extension from adhering to the end comprises a portion of the tape extension being folded back upon itself to cover any exposed adhesive surfaces such that the adhesive properties of the adhesive tape are nullified.

4. A packaging according to claim 2, wherein the means for preventing the tape extension from adhering to the end of the block comprises a film of paper or similar sheet material covering the adhesive surface of the adhesive tape.

5. A packaging according to claim 4, wherein the adhesive tape has two tape extensions, one tape extension at each end of the parallelepiped block, the tape extensions forming two oppositely placed grip handles.

6. A packaging according to claim 1, wherein the adhesive tape has an adhesive free portion at one end whereby the adhesive free portion forms a manual grab tab for enabling the adhesive tape to be easily removed whenever the package is being opened.

7. A packaging according to claim 1, wherein the artificial tripe forming the parallelepiped block is cellulosic tripe.

8. A packaging according to claim 1, wherein the artificial tripe forming the parallelepiped block is fibrous tripe.

9. A packaging according to claim 1, wherein the artificial tripe forming the parallelepiped block is plastic tripe.

10. A packaging according to claim 1, wherein the artificial tripe forming the parallelepiped block is collagenous tripe.

11. A packaging according to claim 1, wherein the lengthwise sealing line is located over one of the opposed surfaces of a greater surface area of the parallelepiped block.

12. A packaging according to claim 1, wherein the lengthwise sealing line defined by the cover is positioned over one of the surfaces of the parallelepiped block having a smaller surface area than said opposed surfaces of greater surface area.

13. A packaging according to claim 12, wherein the lengthwise sealing line is centered on the smaller surface area surface.

14. A packaging according to claim 1, wherein the cover is retractile.

* * * * *